US009546850B2

(12) United States Patent
Boretto

(10) Patent No.: US 9,546,850 B2
(45) **Date of Patent: *Jan. 17, 2017**

(54) SMALL DIAMETER CROSSBOW BOLT

(71) Applicant: Aldila Golf Corp., Poway, CA (US)

(72) Inventor: Tod Douglas Boretto, Poway, CA (US)

(73) Assignee: Aldila Golf Corp., Poway, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/558,291

(22) Filed: Dec. 2, 2014

(65) Prior Publication Data

US 2015/0087450 A1 Mar. 26, 2015

Related U.S. Application Data

(62) Division of application No. 13/740,154, filed on Jan. 11, 2013, now Pat. No. 8,920,268.

(60) Provisional application No. 61/585,621, filed on Jan. 11, 2012.

(51) Int. Cl.
*F42B 6/04* (2006.01)
*F42B 6/02* (2006.01)

(52) U.S. Cl.
CPC .. *F42B 6/04* (2013.01); *F42B 6/02* (2013.01)

(58) Field of Classification Search
CPC ..... F42B 6/02; F42B 6/04; F42B 6/06; F42B 6/08
See application file for complete search history.

(56) References Cited

U.S. PATENT DOCUMENTS

| | | | | |
|---|---|---|---|---|
| 1,648,376 | A * | 11/1927 | Blodgett | 269/38 |
| 2,288,562 | A * | 6/1942 | Birkhofer et al. | 473/586 |
| 2,525,332 | A * | 10/1950 | Alger et al. | 473/586 |
| 4,829,974 | A * | 5/1989 | Anderson | 124/24.1 |
| 4,874,180 | A * | 10/1989 | Fingerson et al. | 473/578 |
| 4,905,397 | A * | 3/1990 | Juelg, Jr. | 43/6 |
| 5,234,220 | A * | 8/1993 | Schellhammer et al. | 473/578 |
| 5,417,439 | A | 5/1995 | Bickel | |
| 5,553,413 | A * | 9/1996 | Gannon | 43/6 |
| 7,331,886 | B2 * | 2/2008 | Morris et al. | 473/578 |

(Continued)

OTHER PUBLICATIONS

Browning Archery, 1990, pp. 24-27, Browning, Morgan, Utah, United States of America.

(Continued)

*Primary Examiner* — John Ricci
(74) *Attorney, Agent, or Firm* — Gary L. Eastman, Esq.; Eastman & McCartney LLP

(57) ABSTRACT

A small diameter crossbow bolt includes a small diameter shaft having a leading end with an insert to receive a point. The trailing end of shaft has a nock and adjacent fletching. The insert receives a point, such as a target point, broad head, or other point known in the industry. A circumferential spacer is positioned along the shaft between the insert and nock and moved along the shaft as needed to locate the insert for a particular weight distribution, center of gravity positioning, or to separate the spacer from nock. The insert, nock, and spacer each have a diameter substantially equal to the diameter of a prior art bolt. When the diameters of the nock and spacer are equal to the diameter of a prior art bolt, the small diameter crossbow bolt of the present invention can be used interchangeably with prior art bolts without modification to the crossbow.

19 Claims, 6 Drawing Sheets

(56) References Cited

U.S. PATENT DOCUMENTS

| | | | | |
|---|---|---|---|---|
| 7,758,457 | B2 * | 7/2010 | Marshall | 473/586 |
| 8,057,330 | B2 | 11/2011 | Blosser et al. | |
| 8,262,518 | B2 | 9/2012 | Palomaki et al. | |
| 8,388,473 | B2 * | 3/2013 | Smith | 473/578 |
| 8,460,134 | B2 | 6/2013 | Palomaki et al. | |
| 8,920,268 | B2 * | 12/2014 | Boretto | 473/578 |
| 2009/0163308 | A1 * | 6/2009 | Odabachian et al. | 473/582 |

OTHER PUBLICATIONS

Browning 1992 Archery Products, 1992, pp. 24-27, Browning, Morgan, Utah, United States of America.

* cited by examiner

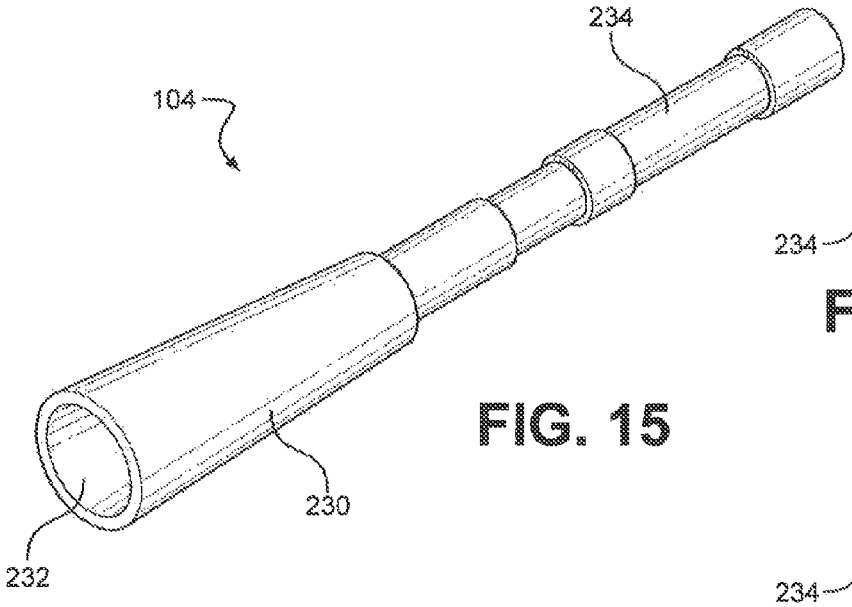
FIG. 15
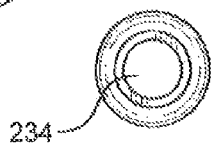
FIG. 17
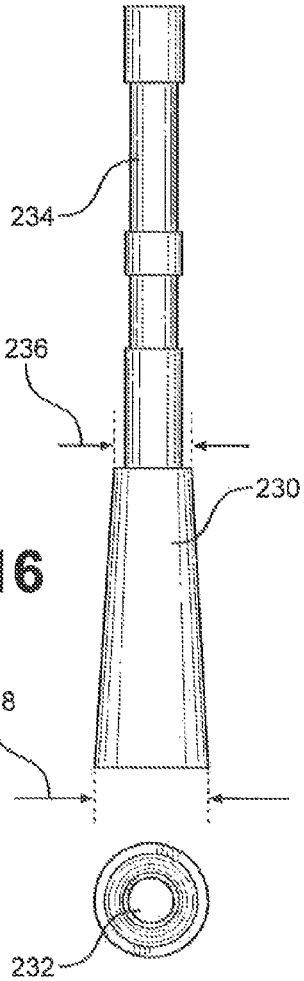
FIG. 16
FIG. 18

SMALL DIAMETER CROSSBOW BOLT

RELATED APPLICATION

The present application is a divisional application of, and claims the benefit of priority to, Utility patent application Ser. No. 13/740,154 filed Jan. 11, 2013, and currently co-pending, which claims the benefit of priority to U.S. Provisional Patent Application Ser. No. 61/585,621 filed Jan. 11, 2012.

FIELD OF THE INVENTION

The present invention relates generally to archery. The present invention is more particularly, though not exclusively, related to crossbow arrows, commonly referred to as "bolts", and which have a reduced diameter and increased spine for improved flight and penetration characteristics.

BACKGROUND OF THE INVENTION

The use of the bow and arrow dates back to ancient civilizations. In such times, primitive bows were made from elastic wooden limbs, and arrows were made from wooden shafts with points made from flint on the leading edge of the arrow, and feathers attached to the trailing edge. For many centuries, the bow and arrow was an essential weapon during wartime, and a necessary tool for hunting. However, with the development of firearms, archery had become nearly obsolete.

In the 1920s, professional engineers took an interest in archery and led the commercial development of new forms of the traditional bow, including the modern recurve and compound bow. These modern bow forms are now dominant in modern Western archery. Of the two, the compound bow has become the most widely used type of bow for all forms of hunting in North America.

One form of compound bow commonly in use today is the crossbow. A crossbow consists of a typical bow, either recurve or compound, that is attached to a stock which holds the drawn string. Crossbows have a much smaller draw length than standard bows. As a result, for the same energy to be imparted to the arrow (or bolt) the crossbow has to have a much higher draw weight. Indeed, the draw weight of modern crossbows is several times greater than traditional bows. The draw used to load the crossbow is stored in the bow as elastic potential energy, and when the bowstring is released, this stored energy is imparted to the arrow very quickly. The higher draw weight on the bowstring translates to a greater launching force being applied to the crossbow arrow, or bolt, and a higher initial velocity.

Modern arrows are made to a specified 'spine', or stiffness rating. Typically, in order to maintain accuracy during use, a bolt was necessarily very rigid and capable of withstanding the excessive forces from a crossbow. This mandated a bolt having a large shaft cross section that provided the strength that was required. As a result of this large shaft cross-section, a bolt is typically significantly heavier than a standard arrow.

Nearly all crossbows are manufactured to receive a commonly sized bolt. Specifically, bolts are typically 20" to 22", have an outside diameter of 0.344 inches, and have a mass of roughly 15 grains per inch, including vanes, nock, and inserts. There has traditionally been very little variation in the bolts available on the market. While they may vary slightly in length, the overall shaft diameter and weight-per-inch of the shaft remain relatively constant. As a result, there are very few options for the crossbow hunter when considering bolts.

One challenge facing crossbow hunters is the instability that develops shortly after shooting a crossbow bolt. Specifically, in use, a fletching vane of the crossbow bolt is inserted into a channel formed in the crossbow rail. This channel runs the length of the crossbow, and maintains the position of the bolt on the rail as it is shot from the crossbow. However, due to the positioning of the vane within the channel, and the narrowness of the channel, the vane cannot be attached to the shaft in a helical or offset position. Instead, the vane must be straight, or substantially in alignment with the arrow shaft and channel. This results in a bolt that has insufficient rotation during flight to maintain accuracy past fifty yards.

Helical and offset vane arrangements impart a rolling moment on the bolt in flight, increasing accuracy. This principle is akin to the rifling of a bullet or spiral of a football. Where an offset vane is straight back as it is attached the vane axis is offset from the bolt shaft axis. Helical vanes have a similar offset position but are also curved in a helical manner.

Another challenge facing crossbow hunters is the standardization of crossbow bolt weights. Typically, a crossbow bolt is designed to weigh 425 grains including the vanes, nock, insert, and broad head. While this standardization is intended to facilitate use of the bolts on crossbows designed to shoot 425 grain bolts, it nevertheless minimizes the options available to crossbow hunters to optimize the flight characteristics, accuracy and effectiveness of the bolt.

In light of the above, it would be advantageous to provide a crossbow bolt that is lighter weight than traditional crossbow bolts. It would also be advantageous to provide a crossbow bolt that travels faster than traditional crossbow bolts. It would also be advantageous to provide a crossbow bolt that delivers greater kinetic energy to a target. It is further advantageous to provide a crossbow bolt that is relatively easy to manufacture and comparatively cost effective. It is also advantageous to provide a method of retrofitting traditional arrows for use in a standard crossbow.

SUMMARY OF THE INVENTION

The small diameter crossbow bolt of the present invention includes a small diameter shaft having a leading end with an insert to receive a point. The trailing end of shaft has a nock and adjacent fletching. The shaft is a small diameter fiber reinforced plastic (FRP) arrow having an outer diameter in the range of 0.220 to 0.245 inches, with a typical rating of 8.7 grains per inch.

The insert receives a point, such as a target point, broad head, or any other point known in the industry. A circumferential spacer is positioned along the shaft midway between the insert and nock and moved along the shaft as needed to locate the insert for a particular weight distribution, center of gravity positioning, to accommodate various crossbow rail designs, or to separate the spacer from nock.

The insert, nock, and spacer each have a diameter substantially equal to the diameter of a prior art bolt. When the diameters of the nock and spacer are the same as the diameter of a prior art bolt, the small diameter crossbow bolt of the present invention position the small diameter shaft to sit horizontally above and parallel to the rail, and thus can be used interchangeably with prior art bolts with no modification to the crossbow.

DESCRIPTION OF THE DRAWING

The nature, objects, and advantages of the present invention will become more apparent to those skilled in the art after considering the following detailed description in connection with the accompanying drawings, in which like reference numerals designate like parts throughout, and wherein:

FIG. 15 is a perspective view of the insert of the small diameter crossbow bolt of the present invention, having a body formed with a bore for receiving a point, and a pin extending axially from the body sized to be received within the lumen of the shaft;

FIG. 16 is a top view of the insert of the small diameter crossbow bolt, showing the pin axially aligned with the body;

FIG. 17 is a side view of the insert of the small diameter crossbow bolt, having a body with a diameter larger than the shaft, and showing a taper narrowing towards the shaft; and FIG. 18 is a bottom view of the insert of the small diameter crossbow bolt, showing the axial placement of the bore sized to receive a point.

DETAILED DESCRIPTION

Figure 1:
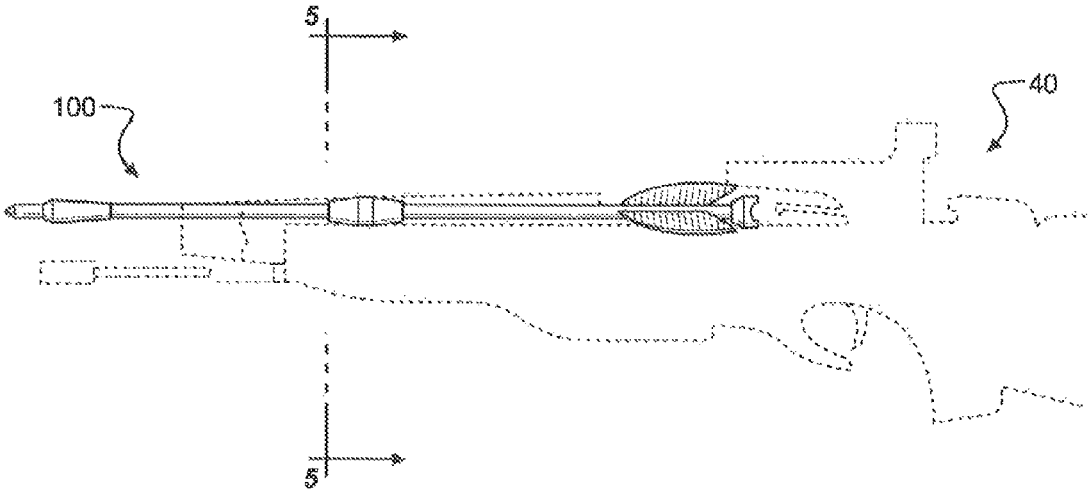
FIG. 1 is a side view of an exemplary crossbow equipped with the small diameter crossbow bolt of the present invention, showing the alignment of the small diameter crossbow bolt along the rails of the crossbow, and positioned for shooting.

Referring initially to FIG. 1, a side view of an exemplary crossbow 40 (shown in dashed lines) is shown and equipped with the small diameter crossbow bolt of the present invention, generally designated 100. From this view, the alignment of the small diameter crossbow bolt 100 along the rails of the crossbow 40 can be appreciated. Bolt 100 has a length 109 and is equipped with a circumferential spacer 112.

Figure 2:
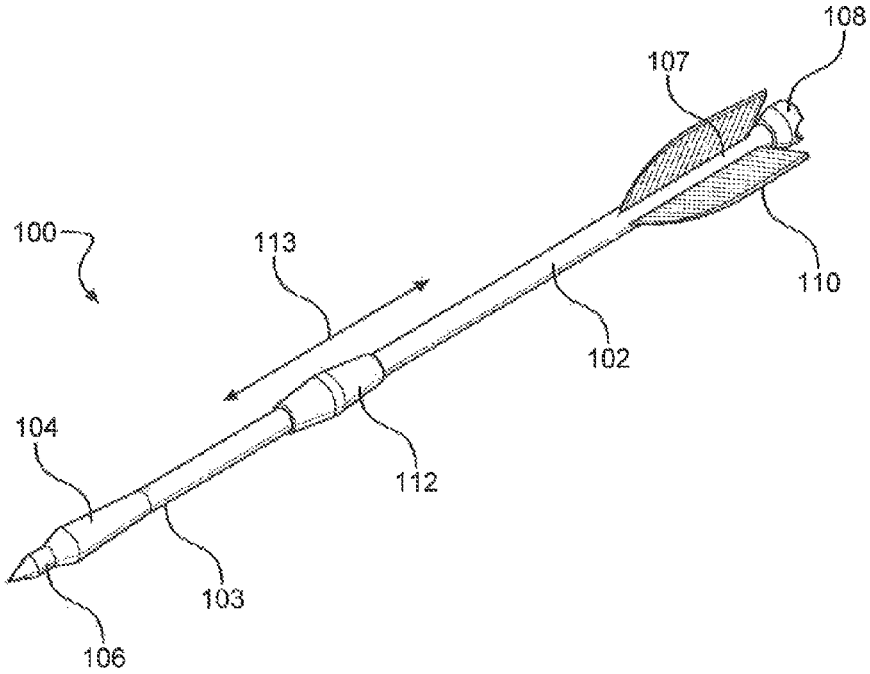
FIG. 2 is a perspective view of the small diameter crossbow bolt of the present invention, showing an elongated small diameter shaft having a leading end with an insert to receive a point, and the trailing end having a nock and adjacent fletching, and a circumferential spacer positioned along the shaft.

FIG. 2 is a perspective view of the small diameter crossbow bolt 100 of the present invention, and includes an elongated small diameter shaft 102 having a leading end 103 with an insert 104 to receive a point 106, and a trailing end 107 having a nock 108 and adjacent fletching 110. Arrow 100 also includes a circumferential spacer 112 positioned in direction 113 along the shaft 102.

Figure 3:
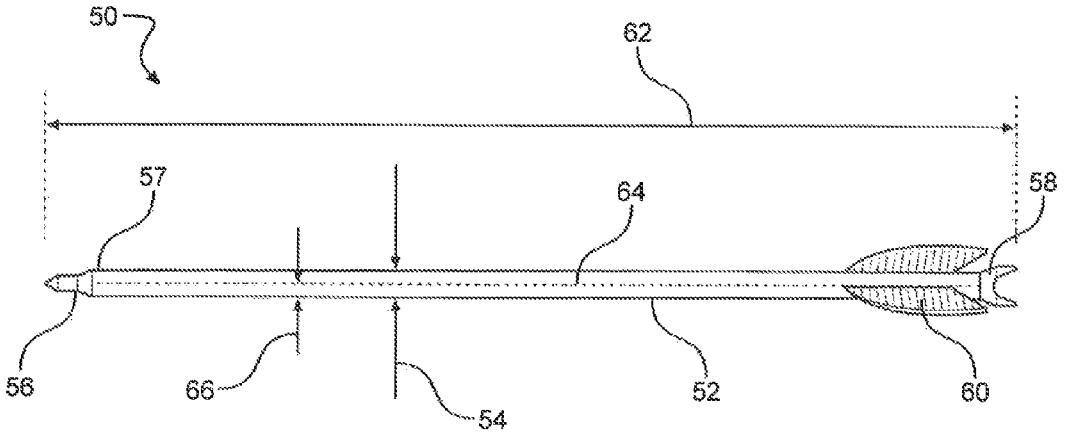
FIG. 3 is a side view of a prior art crossbow arrow, or "bolt" showing a large diameter shaft having an insert at the leading edge, and a nock at the trailing edge and adjacent fletching.

For comparison purposes, FIG. 3 is a side view of a prior art crossbow arrow, or "bolt" 50 showing a shaft 52 having a large diameter 54. Shaft 52 has an insert 56 at the leading end 57, and a nock 58 at the trailing end 59 and adjacent fletching 60.

Prior art bolts typically have length 62 ranging from as short as 15" to 22", and an outside diameter 54 roughly 0.334". Importantly, the bolt 50 includes a center axis 64 that runs longitudinally down shaft 52, and through nock 58. In use, the bowstring passes through nock 58, and must be in line with the bowstring throughout its stroke, or path, when launching the bolt. Failure to match the diameter 54 of shaft 52 to the positioning of the bowstring (not shown this Figure), will result in the incorrect and possible dangerous launching of the bolt.

It is to be appreciated that while the length of the bolt may vary, the distance 66 between the center axis 64 and the outside of the shaft 52 must remain constant, and closely match the position of the bowstring on the crossbow. Since most crossbows are manufactured to receive a common bolt, distance 66 is relatively consistent.

Figure 4:
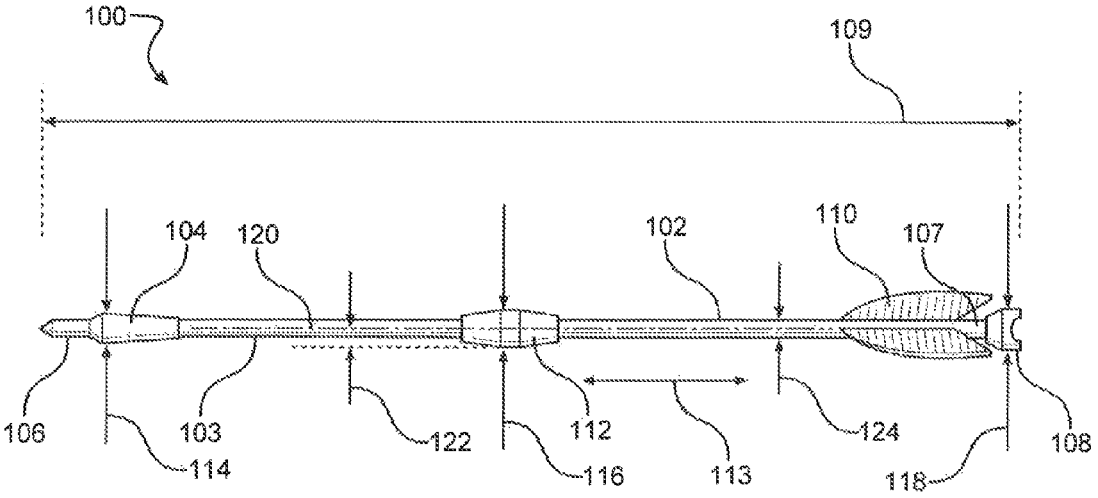
FIG. 4 is a side view of small diameter crossbow bolt of the present invention, showing a small diameter shaft having a leading end with an insert to receive a point, and the trailing end having a nock and adjacent fletching, and a circumferential spacer positioned along the shaft, with the insert, nock, and spacer each having a diameter equal to the diameter of the prior art bolt.

Referring now to FIG. 4, a side view of small diameter crossbow bolt 100 of the present invention is shown. Bolt 100 includes a small diameter shaft 102 having a leading end 103 with an insert 104 to receive a point 106. Shaft 102 is formed with a hollow central bore, or lumen (not shown) that extends along the length of shaft 102 on center axis 120, The trailing end 107 of shaft 102 has a nock 108 and adjacent fletching 110.

Shaft 102, in a preferred embodiment, is a small diameter fiber reinforced plastic (FRP) arrow shaft having an outer diameter 124 in the range of 0.225 to 0.244 inches, with a typical rating of 8.7 grains per inch. Thus, for a standard length crossbow bolt 100 of the present invention having a 22 inch length 109, the overall mass of the shaft 102 would be 191 grains. That mass does not include the additional accessories, such as insert 104, tip 106, nock 108, fletching 110, or circumferential spacer 112.

In comparison to the present invention, the weight of a standard bolt shaft 52 of the same length, rated at 20 grains per inch, is 440 grains. As will be discussed in greater detail below, the decreased non-standard weight of the present invention is significant when considering the transfer from potential energy of the crossbow to the kinetic energy of the bolt. Alternatively, the present invention may be weighted to be the same as a standard bolt, 440 grains per inch, for example, to cooperate with bows that require bolts having a specific minimum bolt weight.

As shown, insert 104 receives a point 106. It is to be appreciated that while a target point 106 has been shown, any other point known in the industry, such as a broad head, can be used without departing from the present invention. Further, points of various weights may be used.

A circumferential spacer 112 is positioned along the shaft 102. The precise positioning of spacer 112 along the length 109 of bolt 100 may vary. As shown, spacer 112 may be moved in direction 113 as needed to position the insert for a particular weight distribution, center of gravity positioning, to accommodate different crossbow designs, to actuate safety sensors on crossbows having a trigger safety, or to separate the spacer 112 from nock 108. The spacer can also be positioned forward of center ("FOC") to improve flight characteristics of the bolt 100.

The positioning of circumferential spacer 112 along shaft 102 creates a shaft 102 having two distinct spine measurements. For instance, by securely positioning and bonding the spacer 112 onto shaft 102 where shown in FIG. 4, the portion of the shaft 102 between the spacer 112 and the insert 104 has one spine measurement, and the portion of the shaft 102 between the spacer 112 and the nock 108 has a different spine measurement. These two regions having distinct spines result in a much more accurate flight in which the oscillations on the front portion of the shaft 102 are of a higher frequency and smaller amplitude, while the oscillations on the rear potion of the shaft 102 may be of a slightly lower frequency and greater amplitude. In combination, the dual spine allows the small diameter crossbow bolt 100 of the present invention to absorb the force from being launched from the crossbow without developing shaft-long low frequency high amplitude oscillations that may result in changes in the trajectory of the bolt. By positioning the circumferential spacer 112 along the shaft 102, the frequency and amplitude of oscillations on the front portion and rear portion of the shaft 102 may be adjusted. The overall effect is that of a stiffer shaft 102.

From FIG. 4, it is shown that the insert 104, nock 108, and spacer 112 each have a diameter equal to the diameter of the prior art bolt 50. Specifically, insert 104 has a diameter 114, spacer 112 has a diameter 116, and nock 108 has a diameter 118. In a preferred embodiment, each of these diameters 114, 116, and 118 are the same, and equal to the diameter 54 of prior art bolt 50. When the diameters 114, 116, and 118 are the same as diameter 54 or prior art bolt 50, the distance 122 from the central axis 120 of shaft 102 to the outer edge of the spacer 112 will be the same as the distance 66 from the central axis 64 of the shaft 52 to the outer edge of the shaft 52. This allows the small diameter crossbow bolt 100 of the present invention to be used interchangeably with prior art bolt 50 with no modification to the crossbow.

The circumferential spacer 112 and nock 108 are the only portions of the small diameter crossbow bolt of the present invention which are in contact with the crossbow 40. The decreased contact area as compared to a typical bolt provides the small diameter crossbow bolt of the present invention with a high speed due to reduced friction on the rail, and a quieter launch resulting in less noise that could startle the target. The small diameter crossbow bolt 100 of the present invention is in contact with approximately five percent (5%) of the rail as compared to a standard bolt, resulting in a significant decrease in friction and noise. In a preferred embodiment, the same contact area of small diameter crossbow bolt 100 is as little as two percent (2%) compared to prior art bolt 50.

The flight of the small diameter crossbow bolt of the present invention is further improved through the use of a small diameter shaft 102. This small diameter 124 is less than a standard bolt, and as a result, is less subject to deflection from crosswinds that would otherwise push the bolt downwind affecting accuracy and precision. Indeed, the decrease in shaft diameter from a standard bolt of 0.334 inches to the small diameter crossbow bolt of the present invention of 0.220 inches represents an approximately 30 percent decrease in surface area subject to wind interference. This decrease results in a stark improvement in accuracy of the small diameter crossbow bolt of the present invention when used in windy environments.

An addition to the benefits of decreased wind interference of using a small diameter shaft, the lower weight per unit length allows for the use of a longer shaft 102. Specifically, a longer shaft 102 will be more stable and typically fly straighter than a shorter shaft 52. By using a shaft that has a lower weight-per-inch, the small diameter crossbow bolt 100 of the present invention results in a longer bolt having the same weight of a standard bolt, yet is more accurate at greater distances including over 100 yards.

Figure 5:
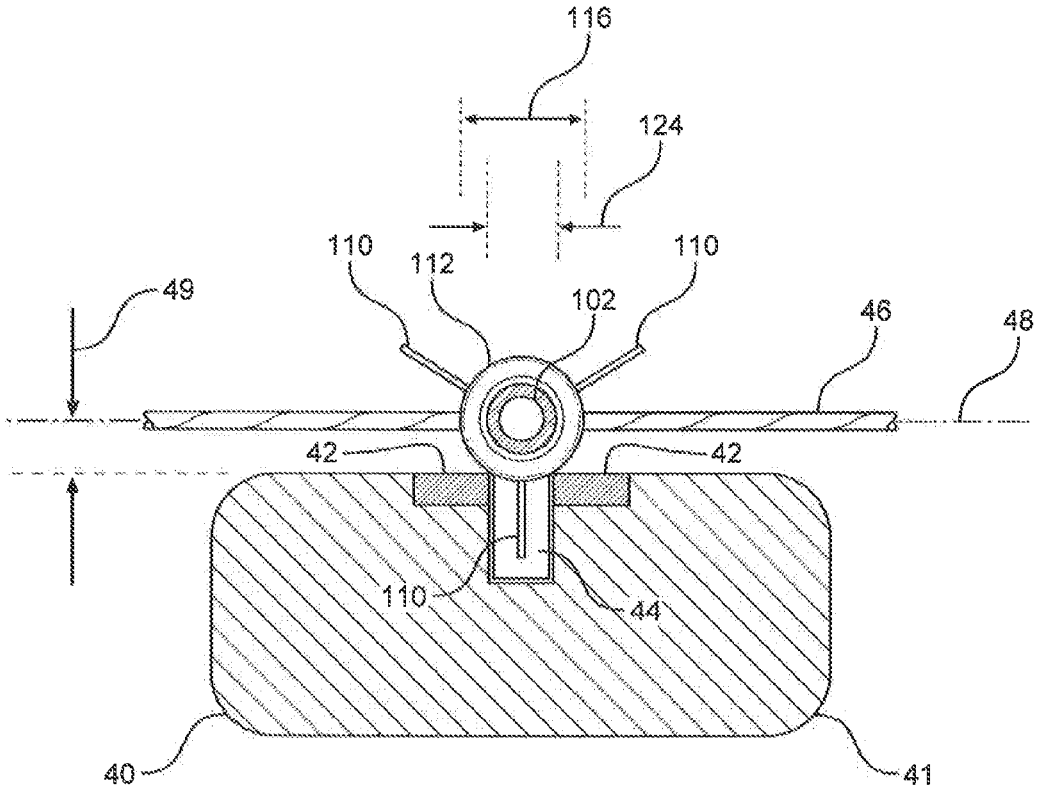
FIG. 5 is a cross-sectional view of the crossbow of FIG. 1, showing the positioning of the small diameter crossbow bolt of the present invention on the rails of the crossbow with a fletching positioned within the runner, and the bowstring passing through the axis of the small diameter crossbow bolt.

Referring now to FIG. 5, is a cross-sectional view of the crossbow 40 of FIG. 1 is shown with the small diameter crossbow bolt 100 of the present invention. Crossbow 40 is shown with a stock 41 having two rails 42 running the length of the stock and separated by a guide channel 44. As shown, small diameter crossbow bolt 100 is positioned on the rails 42 of the crossbow 40 with a fletching 110 positioned within the channel 44, and the spacer 112 riding securely on the rails 42.

Bowstring 46 defines an axis 48 that is a distance 49 from stock 41. This distance must coincide with the positioning of the bowstring receiving channel formed in the nock. By providing the small diameter crossbow bolt 100 with spacer 112 and nock 108 that have the same diameters 116 and 118 to the diameter 54 of the prior art bolt 50, the axis 48 of the bowstring 46 passes through the axis 120 (shown in FIG. 4) of the small diameter crossbow bolt 100.

From this view, the comparison of the diameter 116 of the spacer 112 and the diameter 124 of the shaft 102 is clear. Without the spacer 112, the small diameter shaft 102 would slide substantially within the channel 44 and bind. Also, if using a small diameter shaft 102 without the spacer 112, the position of a standard nock would not be in proper position for engaging bowstring 46. This would result in inconsistent firing and flight of the bolt.

Another feature of the small diameter crossbow bolt of the present invention includes the positioning of the shaft above the rail which also provides for the use of helical vanes. Specifically, because the shaft 102 does not ride within channel 44, the fletching 110 can be positioned on the shaft 102 at an angle to the center axis 120 of the shaft 102. The addition of offset or helical vanes to the small diameter crossbow bolt of the present invention allows for a faster axial rotation of the bolt during flight, which in turn results in a more accurate flight, less subject to misdirection due to shaft flexing and the effects of wind.

Referring back to FIG. 1, it can be appreciated that the length 109 of the small diameter crossbow bolt 100 of the present invention may vary without departing from the present invention. Specifically, spacer 112 and nock 108 are the only portions of the bolt 100 that must contact the rails 42 of the crossbow. Indeed, as shown in FIG. 1, insert 104 is positioned forward of the stock 41 of crossbow 40, and thus do not contact rails 42, or any other part of the crossbow 40. As a result, any point 106 may be used interchangeably without consideration for compatibility with crossbow 40.

Figure 6:
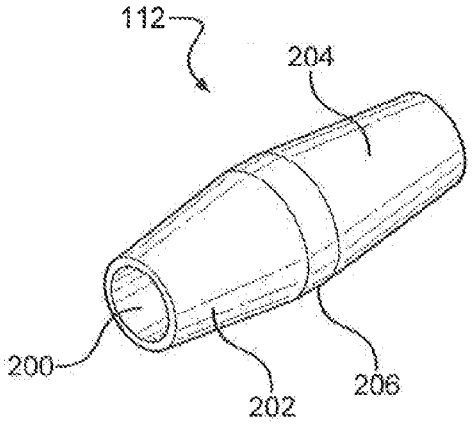
FIG. 6 is a perspective view of the circumferential spacer of the small diameter crossbow bolt of the present invention, having an axial bore sized to closely receive the small diameter arrow shaft and a leading taper, a contact band, and trailing taper.

FIG. 6 is a perspective view of the circumferential spacer 112 of the small diameter crossbow bolt 100 of the present invention. Spacer 112 is formed with an axial bore 200 sized to closely receive the small diameter arrow shaft 102. Spacer 112 is formed to have a leading taper 202 and a trailing taper 204, with a contact band 206 therebetween. The contact band 206, in a preferred embodiment, is smooth and intended to slide with no perceptive friction along rails 42. The entirety of spacer 112 may be formed of a low friction material to achieve this low friction requirement, Contact band 206 may further be coated with a low friction material to further decrease friction between the bolt 100 and the rails 42.

In use, shaft 102 is inserted into bore 200 of spacer 112, and spacer 112 is advanced in direction 113 into position along shaft 102. Once in position, spacer 112 is secured in place using an adhesive, such as a glue, epoxy, or other suitable bonding agent known in the art.

Figure 7:
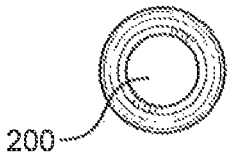
FIG. 7 is an end view of the circumferential spacer showing the axial bore and relative thickness of the spacer.
Figure 8:
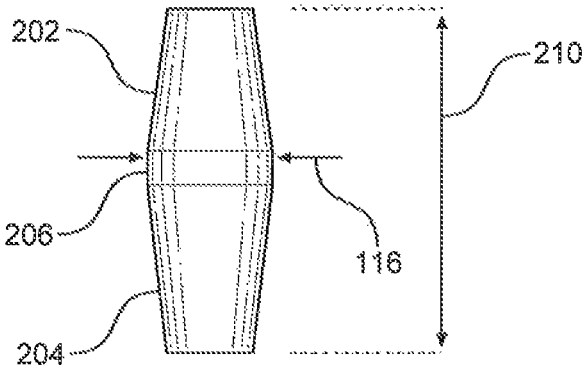
FIG. 8 is a side view of the circumferential spacer showing the leading taper, contact band, and trailing taper.

FIG. 7 is an end view of the circumferential spacer 112 showing the axial bore 200 and relative thickness of the spacer. FIG. 8 is a side view of the circumferential spacer showing the leading taper 202, contact band 206, and trailing taper 204. From this Figure, it is to be appreciated that the length 210 of spacer 112 may vary in order to create a spacer having different taper angles and diameters 116. Also, while leading taper 202 and trailing taper 204 have been shown to be symmetrical, such is not a requirement of the present invention. Rather, the leading taper 202 and trailing taper 204 may have different taper angles and may have different lengths. Also, while leading taper 202 and trailing taper 204 are shown to be linear tapers, it is also fully contemplated that the tapers can be nonlinear. For instance, leading taper 202 could be rounded and have an aerodynamic contour as is known in the art.

Figure 9:
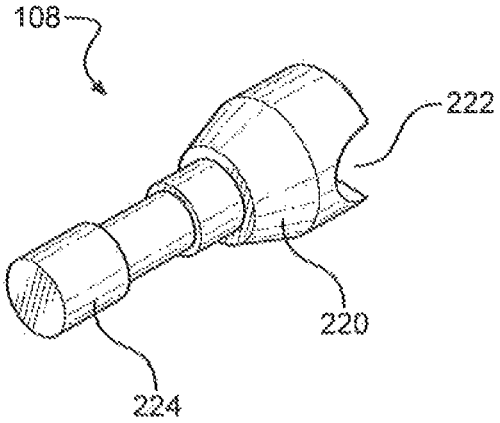
FIG. 9 is a perspective view of the nock of the small diameter crossbow bolt of the present invention, having a body formed with a bowstring channel for receiving a bowstring, and a pin for inserting into the lumen of the shaft.

Referring now to FIG. 9, a perspective view of the nock 108 of the small diameter crossbow bolt 100 of the present invention is shown. Nock 108 includes a body 220 formed with a bowstring channel 222 for receiving a bowstring (not shown this Figure). A pin 224 extends from body 220 opposite channel 222 for inserting into the lumen of the shaft 102. As shown, pin 224 is sized to be closely received within shaft 102 and secured in place using an adhesive, such as a glue, epoxy, or other suitable bonding agent known in the art.

Figure 10:
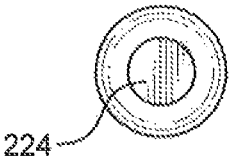
FIG. 10 is a top view of the nock of the small diameter crossbow bolt, showing the pin axially aligned with the body.
Figure 13:
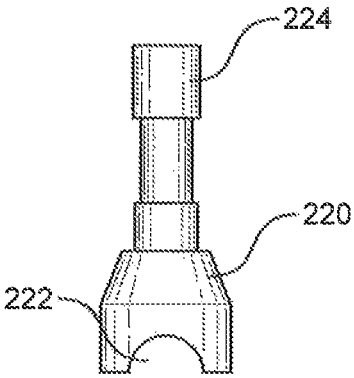
FIG. 13 is a front view of the nock of the small diameter crossbow bolt, showing the body formed with a bowstring channel sized to receive the bowstring during use.
Figure 12:
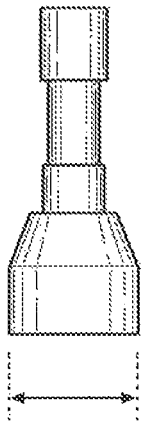
FIG. 12 is a side view of the nock of the small diameter crossbow bolt, having a body with a diameter larger than the shaft.
Figure 11:
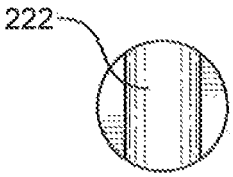
FIG. 11 is a bottom view of the nock of the small diameter crossbow bolt, formed with a bowstring channel sized to receive the bowstring during use.

FIG. 10 is a top view of the nock 108 of the small diameter crossbow bolt 100, showing the pin 224 axially aligned with the body 220. FIG. 11 is a bottom view of the nock 108 of the small diameter crossbow bolt 100, formed with a bowstring channel 222 sized to receive the bowstring during use. FIGS. 12 and 13 are side views of the nock 108 of the small diameter crossbow bolt 100, showing body 220 with a diameter 118 larger than the pin 224, and formed with a bowstring channel 222.

Nock 108 is shown to have a linear surface tapering from pin 224 to bowstring channel 222. It is to be appreciated, however, that the angular transition in body 220 may be smooth and curved to provide a gradual transition from the pin 224 to channel 222 without departing from the present invention.

While the spacer 112 and nock 108 have been described in alternative embodiments having various contours and shapes, what is essential to the present invention are the diameters 116 and 118 being equal to the diameter 54 of a prior art bolt 50. By providing spacer 112 and nock 108 of the same diameter 54 of bolt 50, the small diameter crossbow bolt 100 of the present invention may be interchangeably used with all crossbows 40 without any modification whatsoever.

Figure 14:
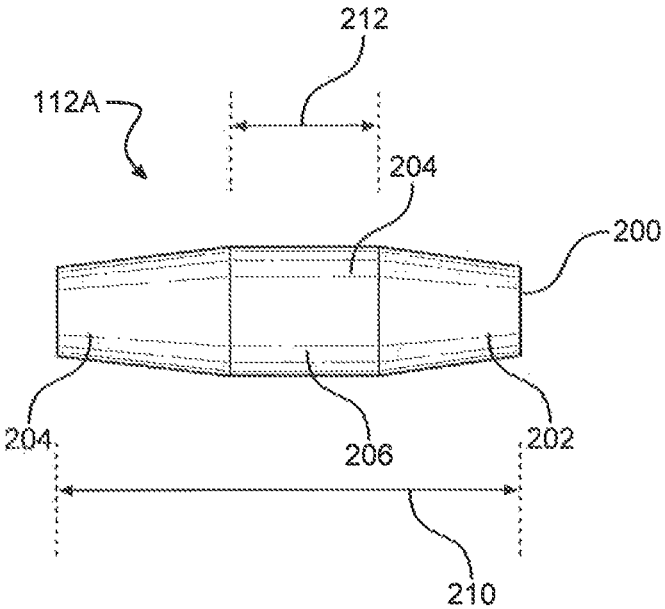
FIG. 14 is an elongated circumferential spacer having an elongated central spacer portion that is intended to contact the crossbow bolt over a larger distance and to actuate any safety switches on the crossbow.

FIG. 14 is an elongated circumferential spacer generally designated 112A, and having an elongated central spacer portion 204 with a length 212. A front and rear tapered portion 202 and 204 provide aerodynamic flow over the spacer. In a preferred embodiment, the bolt 100 of the present invention may incorporate spacer 112A where the crossbow bolt includes a safety switch integral to the crossbow rail that must be depressed in order to fire the arrow from the crossbow. This spacer 112A may be positioned anywhere along the length of the arrow in order to actuate the integrated safety switch of the crossbow.

Referring to FIG. 15, a perspective view of the insert 104 of the small diameter crossbow bolt 100 of the present invention is shown. Insert 104 includes a body 230 formed with a bore 232 for receiving a point (not shown this Figure). Bore 232 is internally threaded to receive a point, such as a target point, or a broad head for hunting. Best seen from FIG. 16, a pin 234 extends axially from the body 230 opposite bore 232 and is sized to be closely received within the lumen of the shaft 102, and secured in place using an adhesive, such as a glue, epoxy, or other suitable bonding agent known in the art.

FIG. 17 is a top view of the insert 104 of the small diameter crossbow bolt 100 and shows the pin 234 axially aligned with the body 230. FIG. 16 is a side view of the insert 104 of the small diameter crossbow bolt 100, having a body 230 with a diameter 238 larger than the shaft 102, and showing a taper narrowing from the bore 232 from a diameter 238 towards the leading end 103 of shaft 102, to a diameter 236, equaling the diameter 124 creating a smooth and aerodynamic transition along the bolt's 100 peripheral surface from insert 104 to shaft 102. FIG. 18 is a bottom view of the insert 104 of the small diameter crossbow bolt 100, showing the axial placement of the bore 232 in body 230 and sized to receive a point.

The insert 104, nock 108, and circumferential spacer 112 as described herein are, in a preferred embodiment, made from lightweight aluminum. As a result, the added weight to the small diameter crossbow bolt of the present invention is negligible. Other materials are fully contemplated herein, including but not limited to steel, titanium, metallic alloys, high density plastics, polypropylene, and delrin.

Increased Kinetic Energy

In addition to the lack of variety in selecting prior art crossbow bolts, the common perception when considering crossbow bolt design includes the belief that a heavier bolt provides more force on the target. As a result, there is an advantage to the creation of a non-standard bolt that is lighter than the prior bolts. The lighter weight bolt can, in some cases, be used with a standard crossbow having a high draw weight, and the bolt being lighter weight will leave the crossbow at a higher velocity than a standard bolt. Alternatively, the lighter weight bolt can be used in conjunction with a weaker crossbow having a lesser draw weight, yet the lighter weight bolt will leave the crossbow at the same velocity as a standard bolt.

The force, or kinetic energy, delivered by the bolt, is a function of the mass and velocity.

$$E_K = \frac{1}{2}mv^2 \quad \text{Equation 1:}$$

Where $E_k$ is the kinetic energy, m is mass, and v is velocity.

Common perception in the archery industry includes the belief that the higher the mass of the bolt, the higher the kinetic energy. This common perception, however, fails to consider the decreased velocity caused by the increased mass (and weight) of the bolt. A crossbow bowstring has a fixed amount of elastic potential energy stored when loaded. This potential energy, less any internal crossbow resistance, is transferred to the bolt upon release.

The small diameter crossbow bolt 100 of the present invention utilizes the benefit of lower mass to increase its velocity. Specifically, the acceleration experienced by the bolt is the result of the bowstring force applied to the mass of the bolt.

$$F = ma \quad \text{Equation 2:}$$

Where F is the force exerted by the bowstring, m is mass, and a is acceleration.

By decreasing the mass of the small diameter crossbow bolt 100 significantly as compared to prior art bolts 50, when considering the fixed potential energy stored within the crossbow, the small diameter crossbow bolt 100 accelerates at a much greater rate off of the bowstring. This greater acceleration results in the small diameter crossbow bolt 100 having an initial velocity far greater than a prior art bolt 50.

As an example, a small diameter crossbow bolt 100 of the present invention with an estimated mass of 360 gr is compared to a 400 grain prior art bolt 50, both with tips installed. If the crossbow stores 500 units of force when loaded, then using Equation 2 above:

| Bolt Type | Mass | Force | Acceleration |
|---|---|---|---|
| Bolt 100 | 400 grains | 500 | 1.25 |
| Prior Art Bolt | 565 grains | 500 | 0.88 |

Based on the above simplified analysis, it is clear that the twenty-five percent (25%) decrease in mass results in a twenty-five percent increase in acceleration. Given that the length of the stroke for the crossbow bowstring would be constant for each bolt, then the initial velocity of the small diameter crossbow bolt 100 would then be roughly 125 percent of the velocity of the prior art bolt 50.

Since the kinetic energy increases with the square of the velocity, an object doubling its velocity will have four times as much kinetic energy, assuming the same mass.

While the velocity of the bolt 100 is not quite doubled with the decreased in mass, the lighter bolt 100 does travel faster, increasing the kinetic energy with the square of its velocity. Considering the small diameter crossbow bolt 100 of the present invention, the mass is roughly twenty percent (25%) less than the prior art bolt. Using Equation 1 above the kinetic energy of the bolts are evaluated using a velocity of 100 for the prior art bolt 50, and 125 for the small diameter crossbow bolt 100. For ease of calculation, the units of the velocity and energy terms have been omitted.

| Bolt Type | Mass | Velocity | Kinetic Energy |
|---|---|---|---|
| Bolt 100 | 400 grains | 125 | 3,100,000 |
| Prior Art Bolt | 565 grains | 100 | 2,800,000 |

According to the above simplified analysis, the small diameter crossbow bolt 100 will have more kinetic energy than the prior art bolt 50. Indeed, the decrease in weight of the small diameter crossbow bolt 100 results in a greater initial velocity leaving the crossbow, but mass also plays a significant role. Prior art bolt 50, has a slower initial velocity, but has a larger mass.

Many crossbow manufacturers list a minimum bolt weight for their weapons, so as not to damage the string or bow. This type of minimum weight requires the use of small diameter bolt 100 in a configuration that does not necessarily realize significant overall weight reduction; that is, even though the diameter 124 and shaft 102 mass is significantly lower than that of prior art bolt 50, the overall weight of bolt 100 and prior art bolt 50 often remain very similar due to operating requirements of a given crossbow and the addition of a heavier tip 106, circumferential spacer 112, and longer shaft 102. Even though weight is not decreased by much (or at all) in this instance, other advantages are apparent.

Accordingly, use of the small diameter bolt 100 allows an increase in shaft 102 length, better spiral provided by helical fletching giving bolt 100 better stability and accuracy with a longer range, the ability to manipulate the CG and FOC balance through customized placement of the circumferential spacer 112, and a more than 90 percent reduction in rail friction (through use of the circumferential spacer 112 and nock 108), increasing velocity and kinetic energy.

Conversely, a crossbow that allows the use of a lighter bolt provides the above-illustrated ability to use such a bolt 100 in a configuration that not only takes advantage of the lower rail friction but also higher velocity and kinetic energy at target impact.

The small diameter crossbow bolt 100 of the present invention has been tested in the field and performs consistently with the discussion above.

While there have been shown what are presently considered to be preferred embodiments of the present invention, it will be apparent to those skilled in the art that various changes and modifications can be made herein without departing from the scope and spirit of the invention.

I claim:

1. A small diameter crossbow bolt comprising:

an elongated small diameter shaft formed having a lumen and a length extending from a leading end to a trailing end; and a circumferential spacer positioned along said elongated small diameter shaft between said leading end and said trading end, said circumferential spacer consisting of a leading taper and a trailing taper opposing said leading taper, a spacer diameter located between said leading taper and said trailing taper extending a length between said leading taper and said trailing taper wherein said leading taper and said trailing taper tapers away from said spacer diameter and said length of said circumferential spacer defines a contact band, and an axial bore extending through said circumferential spacer.

2. The small diameter crossbow bolt of claim 1, wherein said length of said circumferential spacer extends less than 5% of said length of said elongated small diameter shaft.

3. The small diameter crossbow bolt of claim 2, wherein said leading end of said elongated small diameter shaft has an insert, said insert comprises a body having an insert diameter and formed with a bore and a pin, said pin extending axially away from said body opposite said bore and is sized to be closely received within said lumen of said elongated small diameter shaft, said bore formed to accept a crossbow bolt tip.

4. The small diameter crossbow bolt of claim 3, wherein said trailing end of said elongated small diameter shaft has a nook and adjacent fletching, said nock comprises a body haying a nock diameter and formed with a bowstring channel and a pin, said pin extending from said body opposite said bowstring channel.

5. The small diameter crossbow bolt of claim 4, wherein said spacer diameter and said nock diameter are equal.

6. The small diameter crossbow bolt of claim 5 wherein spacer diameter, and said nook diameter is equal to a prior art bolt exterior diameter, and wherein the diameter of said elongated small diameter shaft is less than said spacer diameter and said nock diameter.

7. The small diameter crossbow bolt of claim 6, wherein said bore of said insert is formed with internal threads.

8. The small/ diameter crossbow bolt of claim 7, wherein said insert tapers from said insert diameter to a smaller second diameter such that a smooth transition is realized from said crossbow bolt tip along the peripheral surface to said elongated small diameter shaft.

9. The small diameter crossbow bolt of claim 8, wherein said contact band is rounded to create a smooth surface.

10. The small diameter crossbow bolt of claim 7, wherein said leading taper of said circumferential spacer is symmetrical to said trailing taper of said circumferential spacer.

11. The small diameter crossbow bolt of claim 7, wherein said leading taper of said circumferential spacer and said trailing taper of said circumferential spacer are not symmetrical.

12. The small diameter crossbow bolt of claim 7, wherein said leading taper of said circumferential spacer and said trailing taper of said circumferential spacer are nonlinear.

13. The small diameter crossbow bolt of claim 7, further comprising a low friction coating applied to said circumferential spacer.

14. The small diameter crossbow bolt of claim 7, wherein said circumferential spacer is constructed of a low friction material.

15. The small diameter crossbow bolt of claim 7, wherein said elongated small diameter shaft is formed of fiber reinforced plastic (FRP), having an outer diameter in the range of 0.220 to 0.245 inches.

16. The small diameter crossbow bolt of claim 7, wherein said elongated small diameter shaft has a rating of less than nine grains per inch.

17. The small diameter crossbow bolt of claim 4 wherein said spacer diameter, said nock diameter, and said insert diameter are equal.

18. The small diameter crossbow bolt of claim 4 wherein said spacer diameter, said nock diameter, and said insert diameter are equal to a prior art bolt exterior diameter, and wherein the diameter of said elongated small diameter shaft is less than said midpoint diameter, said nock diameter, and said insert diameter.

19. The small diameter crossbow bolt of claim 3, wherein said circumferential spacer is secured to said elongated small diameter shaft by an adhesive.

* * * * *